US006085060A

United States Patent [19]

Goldmann et al.

[11] Patent Number: 6,085,060

[45] Date of Patent: Jul. 4, 2000

[54] FIXING STATION FOR FIXING TONER IMAGES ON A CARRIER MATERIAL WITH A MOVEABLE FLAP DEVICE

[75] Inventors: Gerd Goldmann; Andreas Eckardt, both of Munich; Guenter Rosenstock, Ottobrunn, all of Germany

[73] Assignee: Oce Printing Systems GmbH, Poing, Germany

[21] Appl. No.: 09/333,550

[22] Filed: Jun. 16, 1999

[30] Foreign Application Priority Data

Jun. 18, 1998 [DE] Germany ..... 198 27 211

[51] Int. Cl.[7] ..... G03G 15/20

[52] U.S. Cl. ..... 399/335; 219/216; 399/68; 399/337

[58] Field of Search ..... 399/337, 336, 399/335, 320, 67, 68, 21, 33, 361; 219/216, 388; 430/97, 124; 432/56, 59

[56] References Cited

U.S. PATENT DOCUMENTS

| | | | |
|---|---|---|---|
| 5,113,223 | 5/1992 | Theodoulou et al. | 219/216 X |
| 5,729,814 | 3/1998 | Suzuki et al. | 399/333 |
| 5,784,679 | 7/1998 | Schlueter, Jr. et al. | 399/335 |
| 5,835,836 | 11/1998 | Hirao | 399/336 |
| 5,887,238 | 3/1999 | Matsuzoe et al. | 399/336 |
| 5,899,169 | 5/1999 | Jenson | 119/51.13 |
| 5,920,757 | 7/1999 | Izawa et al. | 399/335 X |

FOREIGN PATENT DOCUMENTS

| | | |
|---|---|---|
| 62-038490 | 2/1987 | Japan . |
| 6-003984 | 1/1994 | Japan . |

OTHER PUBLICATIONS

Japanese Abstract, Publication No. 09034307, Feb. 7, 1997.

*Primary Examiner*—Sophia S. Chen
*Attorney, Agent, or Firm*—Hill & Simpson

[57] ABSTRACT

A fixing station for fixing toner images on a carrier material is provided in a printer or copier. A flap or shutter mechanism having a plurality of flaps or shutters that are pivotable into an open and into a closed position are arranged between a heat radiation source and the carrier material for controlling fixing of the toner to the carrier material.

11 Claims, 2 Drawing Sheets

FIXING STATION FOR FIXING TONER IMAGES ON A CARRIER MATERIAL WITH A MOVEABLE FLAP DEVICE

BACKGROUND OF THE INVENTION

1. Field of the Invention

The present invention is directed generally to a printer or copier using a toner that is fixed on a carrier and in particular to a fixing station for fixing toner images on a carrier material, comprising a heating device having at least one heat emission source that emits radiation in the direction of the carrier material, and comprising a cover with which undesired incidence of radiation onto the carrier material can be prevented.

2. Description of the Related Art

In electrographic printers or copiers, the toner image transferred from an intermediate carrier, generally a photoconductor, onto the carrier material, which is generally paper, must be fixed, i.e. it must be connected to the carrier material so as to be smear-proof and abrasion-resistant. Heat-pressure fixing is usually utilized at present in electrophotography. When no pre-heating of the carrier material is undertaken, which may ordinarily be done for example with the assistance a heating saddle, this heat-pressure fixing is limited in processing speed to approximately 0.5 m/s through 0.7 m/s. In a duplex printing mode wherein the front side and the back side of a carrier material is printed, the fixing process is relatively difficult since both sides are provided with toner images that can still smear. A high toner fixing quality given simultaneous fixing of the front side and of the back side of the carrier material can only be achieved with relatively soft fixing drums, for example silicone drums. These fixing drums have a short surface life and are uneconomical. Such soft fixing drums are therefore utilized only in printers having a relatively low printing volume. Since soft fixing drums are utilized at both sides of the carrier material, the guidance of the carrier material is problematical. Such fixing drums are therefore not suited for the further-processing of continuous form paper.

For these reasons, it is desirable to fix toner images in as contact-free a manner as possible, whereby a relatively broad spectrum of carrier material can be utilized. A further goal of contact-free fixing is comprised in achieving a high toner fixing quality without smearing effects.

A contact-free fixing method is known wherein the toner material is softened with the assistance of a solvent so that it unites better with the fibers of the carrier material. When, however, chromatic toner is employed, it can occur that the color pigments are dissolved to different degrees, which can lead to a far-dependent smearing of the toner images. Moreover, the known environmental problems given the employment of solvents arise.

Another known fixing method that works in a contact-free manner is what is referred to as photoflash fixing, whereby the toner is fixed on the carrier material with the assistance of high-energy light pulses. The wavelength of the radiation usually lies in the visible light through ultraviolet range of the spectrum. Since the different chromatic toners absorb the radiation to different extents in this wavelength range, photoflash fixing is not suitable for multicolored printing.

A further fixing station is disclosed by European Patent Document EP-A-0 629 930. The fixing station is used for an electrostatic printer in order to fix the toner material on paper. A cover device serves the purpose of preventing the incidence of radiation during a warm-up phase or during a standstill of the carrier material. In the closed condition of the cover device, the active surfaces of the heat emission source that emit heat radiation face away from the carrier material. In this condition, the cover device surrounds the heat emission source, so that the warm-up phase is shortened. During normal operation wherein the toner material is fixed on the carrier material as a result of the incident heat radiation, the heat radiation source faces toward the carrier material and radiation can impinge the carrier material unimpeded.

SUMMARY OF THE INVENTION

An object of the present invention is to provide a fixing station that works with high processing speed and assures a high printing quality.

This object is achieved by a fixing station for fixing toner images on a carrier material having a heating device with at least one heat radiation source that emits radiation in a direction of the carrier material, and a cover device arranged essentially parallel to a moving direction of the carrier material and that can interrupt a beam path between the at least one heat radiation source and the carrier material, the cover device including a flap mechanism having a plurality of flaps that are pivotable between an open and a closed position.

Advantageous developments are provided by the flaps having at least have a width of the carrier material. Preferably, the flap mechanism has a length that suffices an order to entirely cover radiation of the heat radiation source in a direction of the carrier material. Given standstill of the carrier material the flaps are closed approximately according to a relationship: $v_R=-v_P$, wherein $v_P$ is a conveying velocity of the carrier material and $v_R$ is a velocity of a boundary line between closed and open flaps. Given further-transport of the carrier material with the velocity $v_P$, the flaps are opened approximately according to a relationship: $v_R=v_P$, wherein $v_R$ is a velocity of a boundary line between closed and opened flaps.

The flaps of one embodiment are rotatable around an approximately centrally arranged rotational axis. In another embodiment, each flap is rotatable around a rotational axis arranged close to its edge, being rotatable at a side facing toward the heat radiation source.

In one embodiment, a resilient member acting on each flap to resiliently prestress the flap to rotate into the closed position is provided. A drive element that pivots each flap alternately into the opened and closed position may also be provided. The drive element may be a magnet drive. A rocker is arranged on a rotational axis of each flap; and a control rod movable in directions approximately parallel to a plane of the rotational axes of the flaps to be brought into engagement with said rockers, so that given a movement of the control rod the flaps are brought alternately into the open and into the closed position. The control rod includes a link contour. A linear drive is connected to said control rod. The linear drive is a circulating chain drive, or a circulating cable drive, or a circulating toothed belt drive. A restoring spring may be mounted to act on each of said rockers that presses the flap into the closed position. A drive is connected to move the control rod, the drive being constructed such that in case of malfunction the control rod is disengaged from the rockers.

In a preferred embodiment, the heat radiation source has a radiation temperature in the range from 500° C. through 800° C. and a maximum intensity of the radiation lies at a wavelength greater then 2 $\mu$m. The heating device includes at least one heat radiation source arranged at both sides of the carrier material, and the cover device includes a respective flap mechanism arranged in the beam path between each of said heat radiation sources and the carrier material. The at least one heat radiation source is a ceramic large-area radiator, or a quartz radiator, or a foil radiator.

According to the invention, the heating device contains a heat radiation source, as a result whereof the fixing process ensues contact-free. Problems in conjunction with the guidance and the pressure charging of fixing drums are thus avoided. The employment of a heat radiation source, however, has the disadvantage that the heating and the cooling of the carrier material involves relatively high time constants, as a result whereof problems can arise when starting printing, upon standstill of the carrier material or given intermittent printing. According to the invention, a flap shutter mechanism is proposed whose flaps or shutters allow radiation from the radiation source to pass through to the carrier material or block it. Defined exposure times for achieving an optimum fixing even given frequent starting and stopping of the movement of the carrier material can be achieved with the assistance of this flap or shutter mechanism. Due to the contact-free heating of the carrier material, a high color reproduceability and uniformity of the fixing of the toner image can be achieved.

A fixing station is preferably employed for a printer or copier that works in A duplex printing mode, whereby toner images of the front side and of the back side of the carrier material are simultaneously fixed. In this type of operation, heating devices and corresponding cover devices are provided at both sides of the carrier material.

BRIEF DESCRIPTION OF THE DRAWINGS

Exemplary embodiments of the invention are explained below with reference to the drawings.

DETAILED DESCRIPTION OF THE PREFERRED EMBODIMENTS

Figure 1:
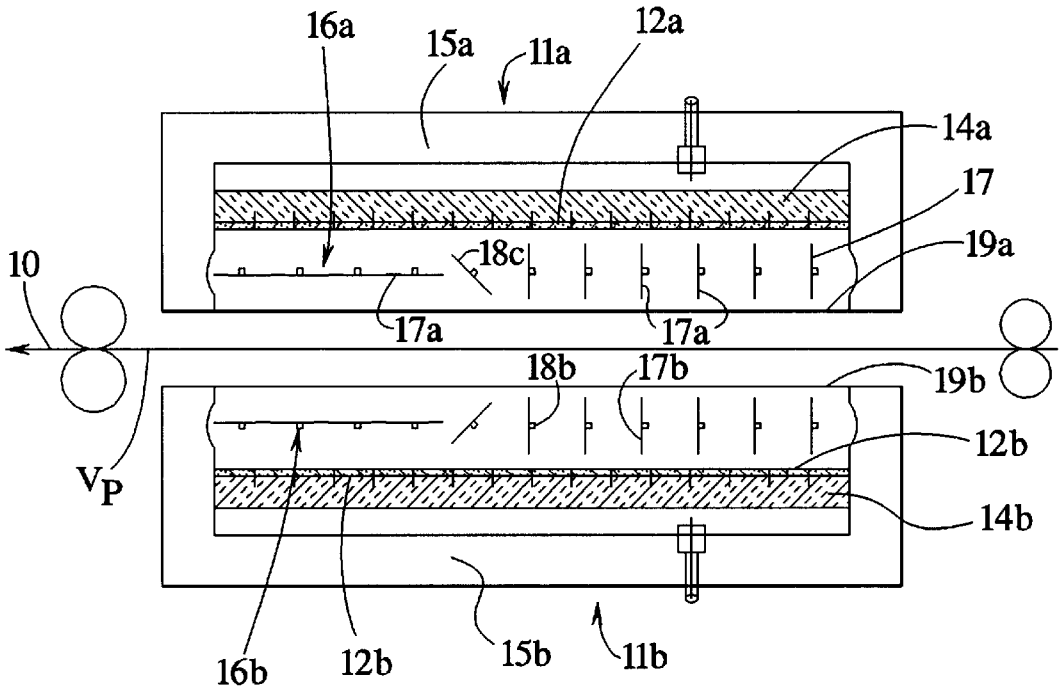
FIG. 1 is a schematic longitudinal section through a fixing station with a flap or shutter mechanism whose flaps or shutters have centrally arranged rotational axes.

FIG. 1 shows a longitudinal section through an inventive fixing station. This fixing station is utilized in a high-performance printer that prints a paper web 10 on both sides. Heating devices 11*a* and 11*b* are arranged at both sides of the paper web 10, these respectively having a heat radiation source 12*a* and 12*b* fashioned as a foil radiator. Each heat radiation source 12*a* and 12*b* has 50 $\mu$m bands that assume a temperature <800° C. when charged with current. The advantage of a foil radiator is 10 comprised therein that it has a low thermal capacity and can thus be rapidly heated and just as rapidly cooled. Other employable heat radiation sources are ceramic extended surface radiators wherein the heating walls are embedded in a ceramic compound. Quartz radiation sources wherein the glow coils are installed in quartz tubes can likewise be employed.

An insulation portion 14*a* and 14*b* is provided around each of the radiation sources 12*a* and 12*b*. The heating devices 11 a and 11 b are thermally insulated toward the outsides by an exterior insulation 15*a* and 15*b*. A respective flap or shutter mechanism 16*a* and 16*b* that contains flaps or shutters 17, 17*a* and 17*b* pivotable around axes 18, 18*a* and 18*b* is arranged between the heat radiation sources 12*a* and 12*b* and the paper web 10. The flaps or shutters 17 are shown both in the opened position as well as in the closed position in FIG. 1. In the open position of the flaps or shutters 17, radiation from the heat radiation sources 12*a* and 12*b* can impinge the surface of the paper web 10 via a protective grating 19*a* and 19*b* nearly unimpeded. In the closed condition of the flaps or shutters 17, the paper web 10 is covered.

The pivot motions of the flaps or shutters 17 are dependent on the operating condition of the paper web 10. Given standstill of the paper web 10, the flaps or shutters 17 are pivoted into the closed condition, as a result whereof a closure which blocks the radiation is produced. The pivoting of the flaps 17 ensues such that the boundary line between open and closed flaps or shutters have an approximate velocity $v_R$ according to the relationship: $v_R=-v_P$, wherein $v_P$ is the conveying speed of the paper web 10. Even given a sudden standstill of the paper web 10, for example as a result of a paper jam or as a result of an operationally caused stopping of the paper web 10, this means that the fixing process can still be maintained for the section of the paper web 10 located under the heat radiation source 12*a* and 12*b* for the same length of time with which it would have been charged with heat radiation given normal further-transport. The section located under the heat radiation sources 12*a* and 12*b* is thus still adequately illuminated in order to fix the toner images despite the stopping of the paper web 10.

Given further-transport of the paper web 10 with the velocity $v_P$, the flaps 17*a* and 17*b* are opened again. The boundary line between closed flaps 17 and opened flaps 17 moves in the same direction as the velocity $v_P$ of the paper web 10. The relationship $v_R=v_P$ applies. What is thereby achieved is that the new section of the paper web 10 coming under the heat radiation sources 12*a* and 12*b* is charged with the correct dose of heat radiation. The preceding section of the paper web 10 is not overexposed.

In FIG. 1, the flaps 17*a* and 17*b* are rotatable around an approximately centrally arranged rotational axis 18*a* and 18*b*. Each flap 17*a* and 17*b* can contain a drive element that pivots the respective flap 17*a* and 17*b* into the opened or closed position. A magnet drive can, for example, be provided as the drive element. The flaps 17*a* and 17*b* can be resiliently prestressed, whereby a spring force turns the flap to the closed position in the absence of our opening force. Given an outage of the drive energy which drives the paper web, a reliable covering of the heat radiation is thus assured.

Figure 2:
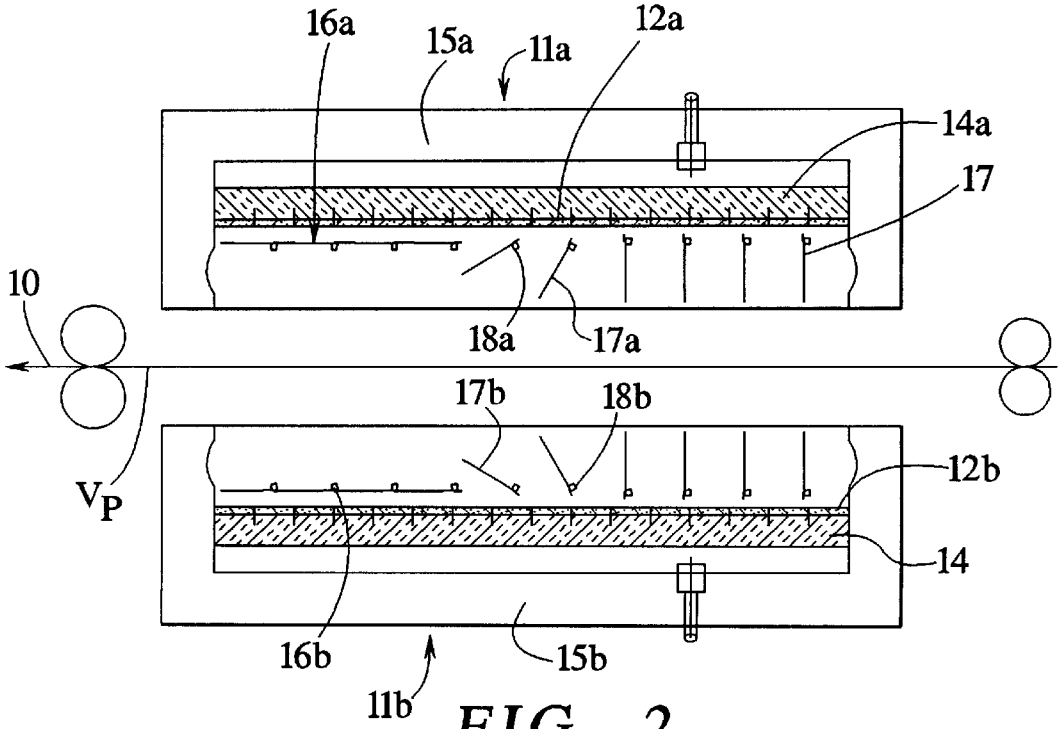
FIG. 2 a longitudinal section through another exemplary embodiment having eccentrically arranged rotational axes of the flaps or shutters.

FIG. 2 shows another exemplary embodiment of the invention, whereby identical parts are in turn identically referenced. Differing from FIG. 1, each flap 17, 17*a* and 17*b* can be rotated around a rotational axis 18, 18*a* and 18*b* that is arranged close to its edge, being rotatable at that side facing toward its respective heat radiation sources 12*a* and 12*b*. Given this arrangement, a better adaptation of the velocity $v_R$ of the boundary line between open flaps and closed flaps to the velocity $v_P$ of the paper web 10 can be achieved. It can be seen in FIG. 2 that flaps 17*a* and 17*b* adjoining one another overlap, so that a radiation-tight covering derives in the closed condition of the flaps 17*a* and 17*b*.

Figure 3:
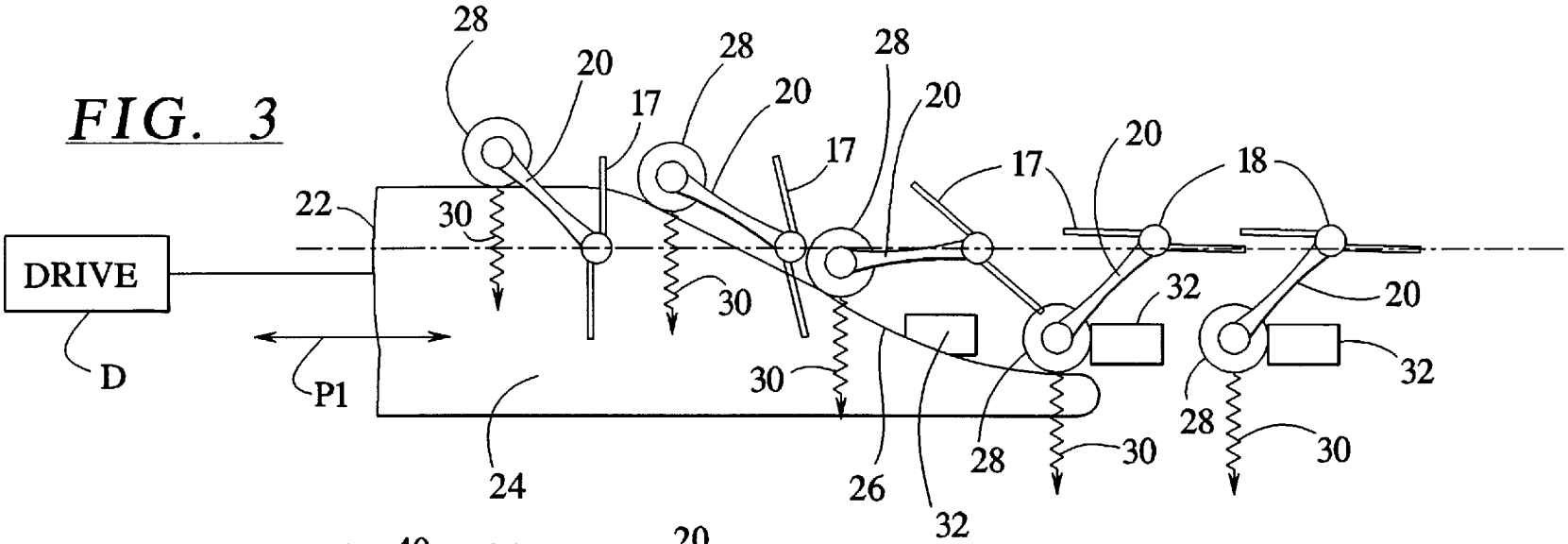
FIG. 3 is an enlarged side view of a flax or shutter control with a rocker and a link.

FIG. 3 shows the control of the flaps or shutters with the assistance of rocker arms 20 and of a link or cam 24. The rotational axes 18 of the flaps 17 are connected to the rocker arms 20. A connecting rod 22 is in the direction indicated by the double arrow P1. The connecting rod 22 actuates the link or cam 24 that has a ramp-shaped link or cam contour 26. Gliders or roller elements 28 run on this link contour 26. Given movement of the connecting rod 22 toward the right in FIG. 3, the roller elements 28 are moved up, as a result whereof the flaps or shutters 17 are pivoted into the opened position. Given a movement of the connecting rod 22 toward the left, the flaps 17 are pivoted into the closed position little by little. Each rocker 20 is connected to a restoring spring 30 that presses the rocker in the direction of a detent or stop 32. This detent 32 defines the closed position of the flap 17. The connecting rod is moved by a drive D as shown in FIG. 3. In case of a malfunction, for example given outage of the current, the connecting rod 22 is moved toward the left in FIG. 3 by the drive D, as a result whereof all of the flaps 17 pivot into the closed position.

Figure 4:
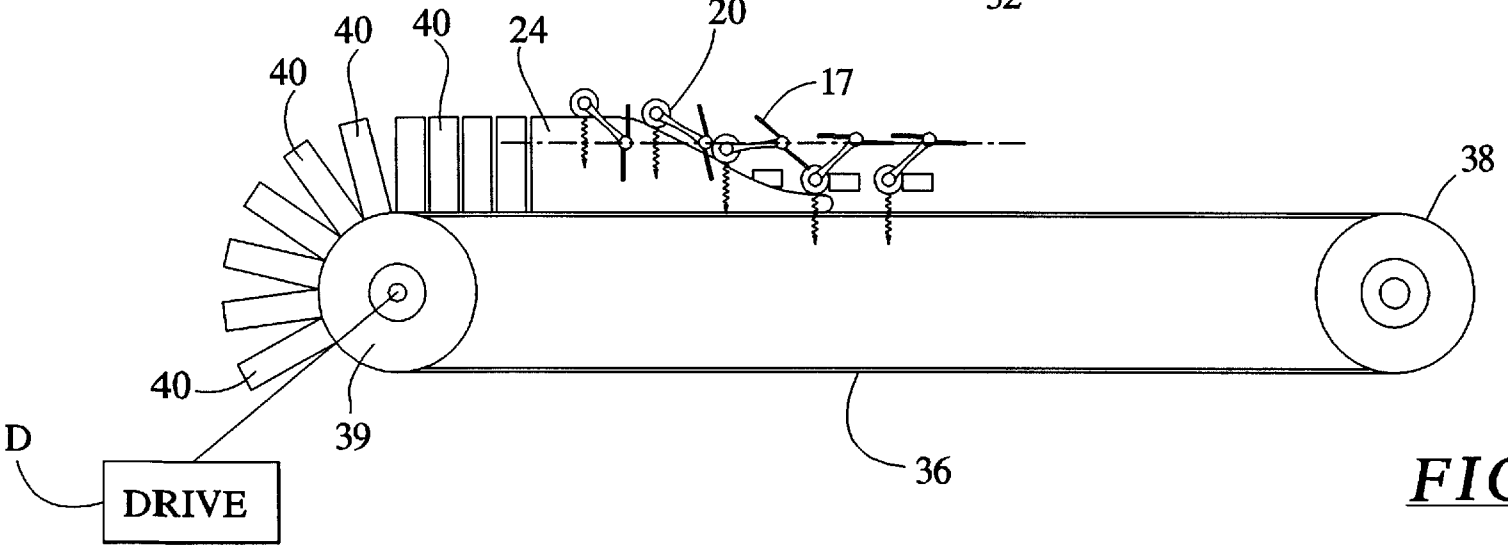
FIG. 4 is a side view of a chain drive with a link put in place and with formed members.

FIG. 4 shows another exemplary embodiment, whereby an endless chain drive 36 is deflected around driven deflection rollers 38 and 39. The link 24 with the ramp-shaped link contour or cam 26 is secured to the chain drive 36. Shaped members 40 are likewise applied on the chain drive 36, isolated from one another. These shaped members 40 are deflected around the roller 39 given movement of the link 24 by a drive D. Given a movement of the link 24 toward the right, the shaped members 40 hold the roller elements 28 at the desired position whereat the flaps 17 are open. Reverse movement closes the flaps 17. The drive D moves the roller 39 so as to close the flaps 17 in the event of a loss of power to the drive D.

Although other modifications and changes may be suggested by those skilled in the art, it is the intention of the inventor to embody within the patent warranted hereon all changes and modifications as reasonably and properly come within the scope of their contribution to the art.

We claim:

1. A fixing station for fixing toner images on a carrier material, comprising:

a heating device having at least one heat radiation source that emits radiation in a direction of the carrier material, and a cover device arranged essentially parallel to a moving direction of the carrier material and that can interrupt a beam path between said at least one heat radiation source and the carrier material, the cover device including a flap mechanism having a plurality of flaps that are pivotable between an open and a closed position, wherein given standstill of the carrier material the flaps are closed approximately according to a relationship:

$$v_R = -v_P,$$

wherein $v_P$ is a conveying velocity of the carrier material and $v_R$ is a velocity of a boundary line between closed and open flaps.

2. A fixing station for fixing toner images on a carrier material comprising:

a heating device having at least one heat radiation source that emits radiation in a direction of the carrier material, and a cover device arranged essentially parallel to a moving direction of the carrier material and that can interrupt a beam path between said at least one heat radiation source and the carrier material, the cover device including a flap mechanism having a plurality of flaps that are pivotable between an open and a closed position, wherein given further-transport of the carrier material with a velocity $v_P$, the flaps are opened approximately according to a relationship:

$$v_R - v_P,$$

wherein $v_R$ is a velocity of a boundary line between closed and opened flaps.

3. A fixing station for fixing toner images on a carrier material, comprising:

a heating device having at least one heat radiation source that emits radiation in a direction of the carrier material, and a cover device arranged essentially parallel to a moving direction of the carrier material and that can interrupt a beam path between said at least one heat radiation source and the carrier material, the cover device including a flap mechanism having a plurality of flaps that are pivotable between an open and a closed position, a rocker arranged on a rotational axis of each flap;

a control rod movable in directions approximately parallel to a plane of the rotational axes of the flaps to be brought into engagement with said rockers; so that given a movement of the control rod the flaps are brought alternately into the open and into the closed position.

4. A fixing station according to claim 3, wherein said control rod includes a link contour.

5. A fixing station according to claim 3, further comprising: a linear drive connected to said control rod.

6. A fixing station as claimed in claim 5, wherein said linear drive is a circulating chain drive.

7. A fixing station as claimed in claim 5, wherein said linear drive is a circulating cable drive.

8. A fixing station as claimed in claim 5, wherein said linear drive is a circulating toothed belt drive.

9. A fixing station according to claim 3, further comprising:

a restoring spring mounted to act on each of said rockers that presses the flaps into the closed position.

10. A fixing station according to claim 3 further comprising:

a drive connected to move the control rod, the drive being constructed such that in case of malfunction the control rod is disengaged from the rockers.

11. A fixing station for fixing toner images on a carrier material, comprising:

a heating device having at least one heat radiation source that emits radiation in a direction of the carrier material, and a cover device arranged essentially parallel to a moving direction of the carrier material and that can interrupt a beam path between said at least one heat radiation source and the carrier material, the cover device including a flap mechanism having a plurality of flaps that are pivotable between an open and a closed position;

wherein the heat radiation source has a radiation temperature in the range from 500° C. through 800° C. and a maximum intensity of the radiation lies at a wavelength greater then 2 $\mu$m.

* * * * *